US008153992B2

(12) United States Patent
Horiike et al.

(10) Patent No.: US 8,153,992 B2
(45) Date of Patent: Apr. 10, 2012

(54) IONIZATION EMITTER, IONIZATION APPARATUS, AND METHOD FOR MANUFACTURING IONIZATION EMITTER

(75) Inventors: Shigeyoshi Horiike, Kyoto (JP); Hiroaki Nakanishi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 447 days.

(21) Appl. No.: 12/523,725

(22) PCT Filed: Jan. 7, 2008

(86) PCT No.: PCT/JP2008/050011

§ 371 (c)(1), (2), (4) Date: Jul. 17, 2009

(87) PCT Pub. No.: WO2008/087866

PCT Pub. Date: Jul. 24, 2008

(65) Prior Publication Data

US 2010/0059689 A1 Mar. 11, 2010

(30) Foreign Application Priority Data

Jan. 17, 2007 (WO) ..... PCT/JP2007/050561

(51) Int. Cl.
*H01J 27/00* (2006.01)

(52) U.S. Cl. ..... 250/423 R; 250/424; 250/425; 250/288

(58) Field of Classification Search ..... 250/423 R–425, 250/288

See application file for complete search history.

(56) References Cited

U.S. PATENT DOCUMENTS 4,638,217 A * 1/1987 Okubo et al. ..... 315/111.81
6,395,183 B1 * 5/2002 Valaskovic et al. ..... 210/656

FOREIGN PATENT DOCUMENTS

| | | | |
|---|---|---|---|
| JP | 6-265534 | A | 9/1994 |
| JP | 3317749 | B2 | 6/2002 |
| JP | 3397255 | B2 | 2/2003 |
| JP | 2004-170447 | A | 6/2004 |
| JP | 2004-532392 | A | 10/2004 |
| JP | 2005-134168 | A | 5/2005 |
| JP | 2005134168 | A * | 5/2005 |
| WO | WO-02/066135 | A1 | 8/2002 |
| WO | WO-2005/075976 | A2 | 8/2005 |
| WO | WO-2005/096720 | A2 | 10/2005 |

OTHER PUBLICATIONS

International Search Report for the Application No. PCT/JP2008/050011 mailed Apr. 1, 2008.

(Continued)

*Primary Examiner* — Michael Maskell
(74) *Attorney, Agent, or Firm* — Cheng Law Group, PLLC

(57) ABSTRACT

Provided is an ionization emitter which can reduce a dead volume without deteriorating separating capacity. An ionization emitter (2) is provided with a tip (1) composed of a columnar or conical porous self-standing structure, and a channel for supplying a solution sample into the tip (1) from the base end side of the tip (1). The channel is formed by filling a pipe line with a packing, and the tip (1) is exposed from the pipe line of the channel. The packing and the porous self-standing structure constituting the tip (1) have an integrated structure composed of a same porous body formed at the same time.

21 Claims, 9 Drawing Sheets

OTHER PUBLICATIONS

Smith, Richard D., et al., "Preparation of 20-μm-i.d. Silica-Based Monolithic Columns and Their Performance for Proteomics Analyses", Analytical Chemistry, 2005, vol. 77, No. 15, pp. 5028-5035.

Brennan, J.D. et al., "Protein-Doped Monolithic Silica Columns for Capillary Liquid Chromatography Prepared by The Sol-Gel Method: Application to Frontal Affinity Chromatography", Analytical Chemistry, 2004, vol. 76, No. 10, pp. 2780-2790.

Bedair, Mohamed et al., "Fabrication of Porous Polymer Monoliths in Polymeric Microfluidic Chips as an Electrospray Emitter for Direct Coupling to Mass Spectrometry", Analytical Chemistry, 2006, vol. 78. No. 4, pp. 1130-1138.

Moore, R. E. et al., "A Microscale Electrospray Interface Incorporating a Monolithic, Poly (styrene-divinylbenzene) Support for On-Line Liquid Chromatography/Tandem Mass Spectrometry Analysis of Peptides and Proteins", Analytical Chemistry, 1998, vol. 70, No. 23, pp. 4879-4884.

Chen, Zilin et al., "Silica-Based Monolithic Columns no Bunseki Kagakuteki Katsuyo ni Kansuru Kenkyu", Journal of Japan Society for Analytical Chemistry, 2005, vol. 54, No. 7, pp. 583-592.

Hosoya, Ken et al., "High-Performance Polymer-Based Monolithic Capillary Column", Analytical Chemistry, 2006, vol. 78, No. 16, pp. 5729-5735.

Notification of Reasons for Refusal for the Application No. 2008-554005 from Japan Patent Office mailed Oct. 4. 2011.

* cited by examiner

IONIZATION EMITTER, IONIZATION APPARATUS, AND METHOD FOR MANUFACTURING IONIZATION EMITTER

TECHNICAL FIELD

The present invention relates to an ionization emitter for use in, for example, mass spectrometric analysis of chemical and biological materials, an ionization apparatus using the ionization emitter, and a method for manufacturing the ionization emitter.

BACKGROUND ART

LC/MS is known as a complementary analytical technique that combines high-performance liquid chromatography (HPLC) as a tool for quantitative separation analysis and mass spectrometry (MS) as a definitive tool for material identification, and is used for analysis of structures and functions of biomolecules, and the like.

Particularly, nano-LC/MS optimized to perform ultramicroanalysis of biological components is widely used as one of the powerful tools for protein identification in the field of post-genome research. Nano-electrospray ionization (nano-ESI) is a technique for online coupling of nano-LC to MS, and uses an emitter formed from a capillary having a sharp tip such as an emitter 42 as shown in FIG. 10.

Nano-electrospray ionization is performed by allowing a solution containing an analyte to pass through an emitter at a flow rate of about 10 nL/min to 1 μL/min and applying a high electric field across the distal end of the emitter and a sample inlet of a mass spectrometer. In this case, the sample solution can be sprayed without using an atomizing gas to ionize the analyte.

Nano-LC generally uses a nano-column having a small column volume and an inner diameter of 75 μm to treat a trace amount of sample solution. In the case of nano-LC, extra-column dead volume causes serious deterioration in separation capacity, and therefore a dead volume created at a junction between an emitter and a column should be minimized. As a result, the diameters of capillaries for use as emitters have already been reduced to several tens of micrometers, and the diameters of distal ends of emitters have already been reduced to several micrometers to efficiently ionize a sample eluted from nano-LC and introduce the ionized sample into a mass spectrometer.

Patent Document 1: Japanese Patent No. 3317749

Patent Document 2: Japanese Patent No. 3397255

Non-Patent Document 1: Anal. Chem. Vol. 78, No. 16, pp. 5729-5735 (2006)

DISCLOSURE OF THE INVENTION

Problem to be Solved by the Invention

As a method for reducing a dead volume created at a junction between an emitter and a column, a method in which a frit is provided in the vicinity of the distal end of an emitter and a packed column is provided inside the emitter is proposed. However, such a method involves a problem that the structural heterogeneity and discontinuity between the frit and a column packing deteriorate separation capacity.

It is therefore an object of the present invention to provide an ionization emitter capable of reducing a dead volume without deteriorating its separation capacity.

Means for Solving the Problem

The ionization emitter of the present invention has a tip and a channel for supplying a solution sample into the tip from the base end side of the tip. The channel is formed by filling a pipe line with a packing, the tip constitutes a columnar or conical porous self-standing structure projecting from the pipe line of the channel to expose a distal end surface and a lateral surface thereof, and the packing and the porous self-standing structure constituting the tip have been simultaneously and integrally formed as a single structure and are composed of a same porous body. A high voltage is applied between the tip and an electrode provided so as to be opposed to the distal end side of the tip to generate electrospray to ionize molecules contained in a solution sample supplied into the tip.

One preferable example of the channel is an analytical column.

The porous self-standing structure can be obtained by a sol-gel method

According to a conventional method for producing a monolithic column by spinodal decomposition, it is possible to control pore size distribution and therefore to produce a monolithic column having a desired pore size distribution, but it is very difficult to achieve the ordering of local structure alignment. This is because the formation of pores by spinodal decomposition is left to chance so that pores are formed on a random basis.

Recent research reports about column theory suggest the possibility that intra-column diffusion of an analyte caused by a nonuniform local structure of a column can be suppressed by producing a geometrically-uniform column using a microfabrication technique. Therefore, it can be expected that a silica monolithic column produced by a conventional sol-gel method will also provide higher performance by making efforts to achieve the ordering of its local structure.

A preferred example of the porous self-standing structure includes one having a skeletal phase having a structure in which a plurality of spherical holes formed using a packed structure of particles as a template are provided. The skeletal phase has a three-dimensional network structure by communicating the spherical holes adjacent to each other with each other at their contact point.

It is preferred that the spherical holes are regularly arranged to form a close-packed structure for making the skeletal phase geometrically uniform.

It is also preferred that the skeletal phase is made of an inorganic material such as silica to have high strength.

It is further preferred that the spherical holes are uniform in size and have a diameter of 0.1 to 10 μm. In order to obtain spherical holes uniform in size, it is preferred that monodispersed particles uniform in size are used as a template. In this case, spherical holes having a hole size distribution of 5 to 10% are obtained.

Furthermore, it is also preferred that the skeletal phase has pores having a diameter smaller than that of the spherical holes to increase the surface area of the packing. The pores preferably have a diameter of 1 nm to 100 nm.

As the porous body constituting the porous self-standing structure, those made of an organic material may be used as long as they have skeletal phases. Examples of such a porous body include one having a skeletal phase having a surface, pores formed by the skeletal phase and forming a continuous three-dimensional network, and a functional group present on the surface of the skeletal phase and permitting the introduction of another functional group. The skeletal phase has a submicron- to micrometer-sized average diameter and a non-particle-aggregation-type co-continuous structure, and is composed of an addition polymer formed from a di- or higher-functional epoxy compound and a di- or higher-functional amine compound, and is rich in organic matter, and contains no aromatic carbon atoms.

Examples of the functional group present on the surface of the skeletal phase and permitting the introduction of another functional group include a hydroxyl group generated by the reaction between an epoxy group and an amino group, a remaining unreacted amino group, and a remaining unreacted epoxy group.

A preferred example of the epoxy compound used as a raw material of the skeletal phase includes 2,2,2-tri-(2,3-epoxypropyl)-isocyanurate. 2,2,2-tri-(2,3-epoxypropyl)-isocyanurate is a chiral compound having an optical isomer. The epoxy compound to be used in the present invention may be in either a racemic or an optically active form.

The amine compound to be used in the present invention may also be chiral. In this case, the amine compound may be in either a racemic or an optically active form.

The column packing may be physically or chemically modified to functionalize the column.

A coating film made of an electrode or a protective film may be formed on the outer surface of the tip to use the tip as a tip of an ionization sprayer and to achieve efficient ionization.

The coating film may be formed by physical or chemical vapor deposition.

The ionization apparatus of the present invention includes: the ionization emitter according to the present invention; a mobile phase supplying system for supplying a mobile phase to the column; an injector for supplying a sample into a channel for supplying the mobile phase to the column; a sample inlet provided so as to be opposed to the distal end of the emitter; and a high-voltage generating device for applying a voltage across the emitter and the sample inlet.

The method for manufacturing the ionization emitter of the present invention includes the steps of:

(A) preparing a mold having a hole having a shape corresponding to an outside shape of the tip; and (B) forming the porous self-standing structure, comprising the steps of: pressing a distal end surface of a hollow tube having an outer diameter larger than a diameter of the hole against the mold in such a state that the hollow tube is aligned over the hole of the mold; injecting a sol solution from a base end side of the hollow tube; and turning the sol solution into a gel.

The step (B) includes sol-gel reaction steps. In one preferable embodiment, the steps (B) includes the following steps (B-1) to (B-5):

(B-1) injecting a colloid containing polymer particles from the base end of the hollow tube; (B-2)forming a packed structure in which the polymer particles are regularly arranged due to their self-assembly properties; (B-3) injecting a metal alkoxide sol to fill interstices between the polymer particles forming the packed structure; (B-4) allowing the metal alkoxide sol to gelate to form a skeletal phase; and (B-5) thermally decomposing and removing the polymer particles to form a porous self-standing structure having a three-dimensional network structure having a plurality of spherical holes formed by molding using the packed structure.

After the completion of formation of the porous self-standing structure, the step of physically modifying the porous self-standing structure by washing the skeletal phase with an alkaline solution to form micropores having a diameter smaller than that of the spherical holes in the skeletal phase may be further contained.

One preferable example of the metal alkoxide sol includes a silica sol. One preferable example of the colloid includes one obtained by dispersing polystyrene polymers in pure water.

In the preferable embodiment, the step (B) includes steps (b-1) and (b-2); (b-1) injecting a solution containing a di- or higher-functional epoxy compound and a di- or higher-functional amine compound in a porogen as a sol followed by polymerization by heating to form a gelled body; and (b-2) washing the gelled body with a solvent to remove the porogen to obtain a skeletal phase. After washing with a solvent, the gelled body is dried.

The polymerization temperature at which polymerization occurs in the porogen is suitably in the range of 60 to 200° C. The polymerization temperature is a temperature suitable for a polymerization reaction between the epoxy compound and the amine compound dissolved in the porogen, and is therefore appropriately set depending on the kinds of epoxy and amine compounds and porogen to be used.

A preferred example of the epoxy compound includes 2,2,2-tri-(2,3-epoxypropyl)-isocyanurate. This epoxy compound may be in either a racemic or an optically active form.

The amine compound is used as a curing agent and may be in either a racemic or an optically active form. Examples of such an amine compound include aliphatic amines such as ethylene diamine, diethylene triamine, triethylene tetramine, tetraethylene pentamine, iminobispropylamine, bis(hexamethylene)triamine, 1,3,6-trisaminomethylhexane, polymethylenediamine, trimethylhexamethylenediamine, and polyetherdiamine; alicyclic polyamines such as isophoronediamine, menthanediamine, N-aminoethylpiperazine, 3,9-bis(3-aminopropyl)-2,4,8,10-tetraoxaspiron, bis(4-aminocyclohexyl)methane, and modified products thereof; and other aliphatic polyamidoamines formed by reacting polyamines with dimer acids. Alicyclic amine compounds each having two or more primary amines in its molecule are preferred, and alicyclic amine compounds, bis(4-aminocyclohexyl)methane and bis(4-amino-3-methylcyclohexyl) methane are particularly preferred.

The porogen refers to a solvent which can dissolve the epoxy compound and the curing agent and can cause reaction-induced phase separation after the polymerization of the epoxy compound and the curing agent. Examples of such a porogen include cellosolves such as methyl cellosolve and ethyl cellosolve; esters such as ethylene glycol monomethyl ether acetate and propylene glycol monomethyl ether acetate; and glycols such as polyethylene glycol and polypropylene glycol. Among them, polyethylene glycols having a molecular weight of 600 or less are preferred, and polyethylene glycols having a molecular weight of 300 or less are particularly preferred.

In a case where 2,2,2-tri-(2,3-epoxypropyl)-isocyanurate is used as the epoxy compound, the molar ratio between the epoxy compound and the amine used as raw materials is suitably in the range of 1:1 to 1:3.

The amount of the porogen to be added is suitably 1 to 99% by weight with respect to the total weight of the epoxy compound, the amine, and the porogen.

Effects of the Invention

As described above, the ionization emitter according to the present invention includes a tip constituted from a porous self-standing structure and a channel, and is used to ionize molecules contained in a solution sample supplied into the tip by electrospray initiated by applying a high voltage across the tip and an electrode. The tip has a plurality of pores each of which can be regarded as an emitter, and therefore the ionization emitter according to the present invention has an improved emitter life and a reduced dead volume as compared to a conventional one having a single emitter.

Further, the packing and the porous self-standing structure constituting the tip have been simultaneously and integrally formed as a single structure and composed of the same porous body. Therefore, in a case where the packing is a column packing, the separation capacity of the ionization emitter is not deteriorated.

Further, unlike a conventional tip formed from a fused-silica tube, the tip of the ionization emitter according to the present invention is projected from the pipe line of the channel to expose a distal end surface and a lateral surface thereof. This makes it possible to eliminate fused silica, which is likely to be damaged by electric discharge at the beginning of use, from an electric field concentration zone and therefore to achieve stable ionization.

DESCRIPTION OF THE REFERENCE NUMERALS

| | |
|---|---|
| 1 | tip |
| 2 | ionization emitter |
| 3 | column |
| 5 | packing |
| 7 | pore |
| 9 | coating film |
| 11 | skeletal phase |
| 13 | spherical hole |
| 15 | mesopore |
| 17 | through hole |
| 19 | electrode |
| 21 | sample inlet |
| 23 | mass spectrometer |
| 25 | injector |
| 27 | pump |
| 29 | high-voltage generating device |

DETAILED DESCRIPTION OF THE INVENTION

Hereinbelow, some embodiments of the present invention will be described in detail with reference to the accompanying drawings.

Figure 1A:
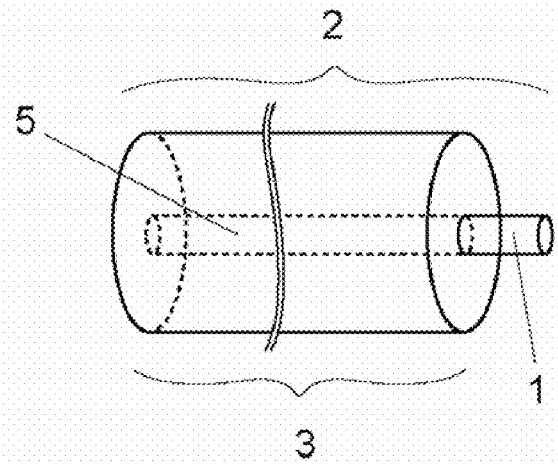
FIG. 1A is a schematic view of an emitter portion of an ionization emitter.
Figure 1B:
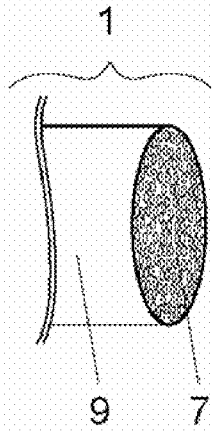
FIG. 1B is a schematic view of the distal end of a tip of an ionization emitter.

FIG. 1A is a schematic view of an emitter portion of an ionization emitter, and FIG. 1B is a schematic view of the distal end of a tip of an ionization emitter. As shown in FIG. 1A, an ionization emitter 2 includes a tip 1 constituted from a cylindrical porous self-standing structure and a channel 3 for supplying a solution sample to the base end of the tip 1.

An example of the channel includes an analytical column 3. The column 3 is filled with a packing 5, and the packing 5 and the porous self-standing structure constituting the tip 1 are integrally formed as a single structure. The tip 1 is projected from the column 3. The packing 5 and the porous self-standing structure constituting the tip 1 having been simultaneously formed and composed of the same porous body. The outer surface of the tip 1 or the column 3 may be coated with a coating film 9 serving as an electrode or a protective film.

As shown in FIG. 1B, a plurality of pores 7 are present in the distal end surface of the porous self-standing structure, and each of the pores 7 can be regarded as an emitter hole. This makes it possible to reduce the need for replacement and maintenance caused by clogging.

Further, as described above, since the packing 5 within the column 3 and the tip 1 having been integrally formed as a single structure and composed of the same porous body, the column 3 and the tip 1 are fully integrated with each other, thereby reducing a dead volume created at a junction between them.

Known examples of such a porous self-standing structure (monolith) as described above include organic ones made of organic polymers such as a styrene-divinylbenzene copolymer, and the like, and inorganic ones such as silica gel, and the like.

Organic packings made of organic polymers such as a styrene-divinylbenzene copolymer and the like have the following drawbacks for the lack of a skeletal structure: they have low strength and low resistance to pressure; they shrink or swell in solvents; and they cannot be thermally sterilized. On the other hand, inorganic packings are free from these drawbacks, and are therefore widely used. Particularly, silica gel is widely used. Inorganic porous bodies such as silica gel and the like are generally produced by a sol-gel method using a liquid phase reaction. The porous self-standing structure to be used in the present invention may be either inorganic or organic. However, when an organic porous self-standing structure is used in the present invention, it should have a skeletal structure.

First, an inorganic porous self-standing structure will be described. In order to use a porous material as a substrate for various materials, the porous material is required to have an optimum pore size, which depends on the size of a material to be supported by the surface of pores to exhibit its function, and a pore size distribution as narrow as possible. Therefore, an attempt to control the pore size of a porous body produced by a sol-gel method has been made by controlling reaction conditions during gel synthesis.

A monolithic column having a porous self-standing structure as a substrate is produced by the spinodal decomposition of a metal alkoxide sol introduced into a hollow tube. According to such a monolithic column production method, it is possible to control a skeletal thickness and a pore size (diameter) to produce a porous self-standing structure having desired skeletal thickness and pore size. Therefore, a monolithic column having a porous self-standing structure as a substrate produced by this monolithic column production method has high separation capacity and a low pressure loss.

Figure 2:
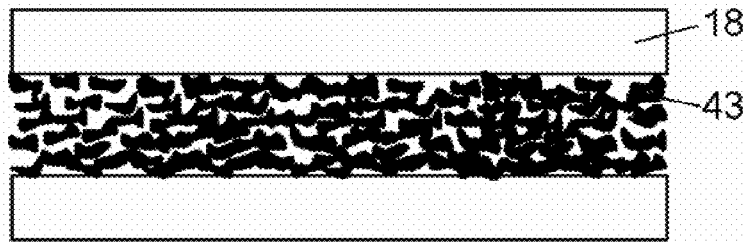
FIG. 2 is a schematic sectional view of a column having a porous self-standing structure.
Figure 3:
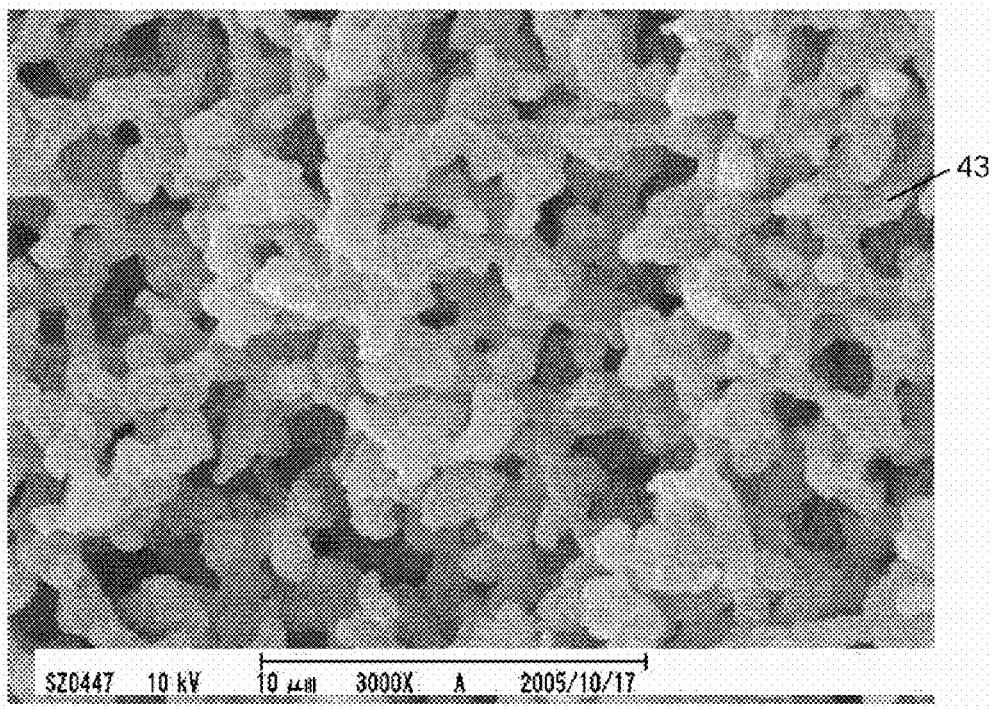
FIG. 3 is a scanning electron microscope image showing the cross section of one example of the porous self-standing structure.

FIG. 2 is a schematic sectional view of a column having a porous self-standing structure produced by the production method, and FIG. 3 is a scanning electron microscope image of the porous self-standing structure shown in FIG. 2. A porous self-standing structure 43 is formed in a hollow tube 18 and mainly made of silica by utilizing spinodal decomposition. In FIG. 2, black portions indicate pores.

Efforts to control a net-like skeleton as a local structure and the pore size of the porous self-standing structure 43 have been made by changing sol composition and gelation conditions, and as a result it has been confirmed by, for example, pore measurement by a mercury intrusion technique that the porous self-standing structure 43 has a uniform local structure.

On the other hand, the performance of packed columns has been enhanced (e.g., an increase in surface area and an increase in analysis speed) by making efforts to miniaturize and spheroidize filler used as a stationary phase (carrier) and to allow the filler to have pores uniform in size. It can be said that the efforts to spheroidize the filler and to allow the filler to have pores uniform in size correspond to efforts to make the local structure of the porous self-standing structure geometrically uniform to achieve uniform diffusion of an analyte.

For example, as a column having an increased surface area, an inorganic porous column having through holes with a hole diameter of 500 nm and mesopores with diameter of 5 to 100 nm formed in the inner surface of the through holes is known (see Patent Document 1). Further, as a method for effectively controlling a porous structure, a method in which a metal alkoxide is used as a starting material and an appropriate coexisting material is added to the starting material to produce a structure having a solvent-enriched phase for forming huge holes is known (see Patent Document 2).

Figure 4:
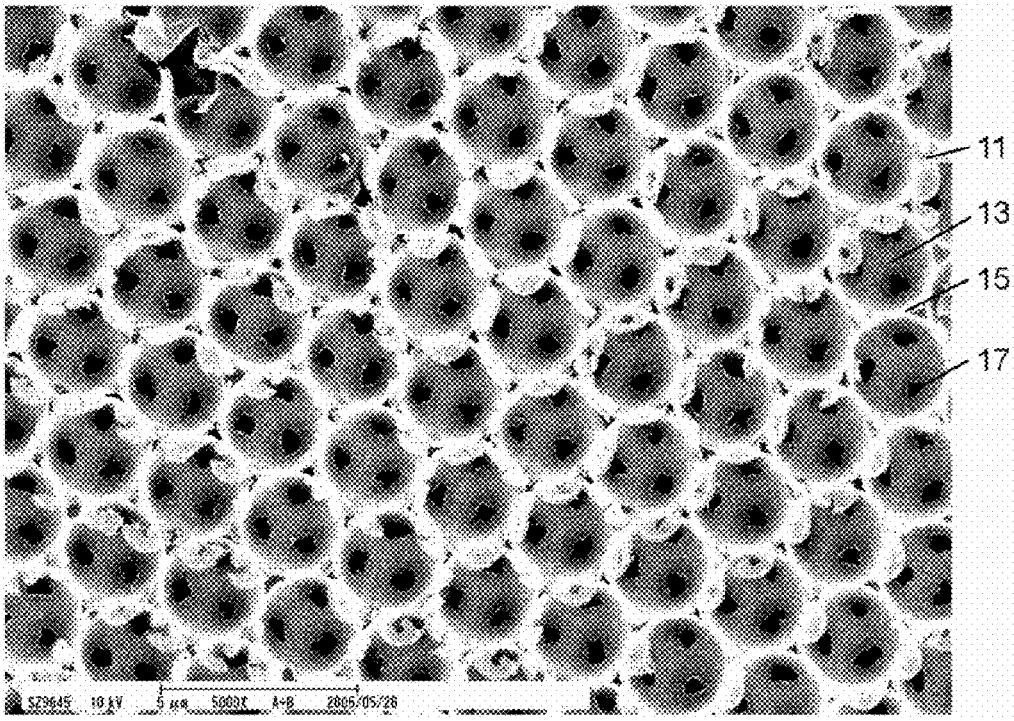
FIG. 4 is a scanning electron microscope image showing the cross section of another example of the porous self-standing structure.

FIG. 4 is a scanning electron microscope image showing the cross section of another porous self-standing structure. Reference numeral 11 denotes a skeletal phase, reference numeral 13 denotes a spherical hole, and reference numeral 15 denotes a mesopore formed in the skeletal phase 11. Each of the holes has a spherical shape and is formed using a polystyrene particle as a template. Three black portions 17 seen at the bottom of each of the holes are through holes, each formed at a junction between the adjacent holes. The porous self-standing structure has a skeletal phase 11 having a structure in which a plurality of spherical holes 13 formed using a packed structure of particles as a template are provided. Further, the spherical holes adjacent to each other communicate with each other at their contact point, and therefore the skeletal phase 11 has a three-dimensional network structure.

When the column 3 has such a porous self-standing structure having a skeletal phase 11 formed using a packed structure of particles as a template so as to have a structure in which spherical holes 13 adjacent to each other communicate with each other, it is possible to achieve more uniform diffusion of an analyte as compared to a case where a conventional column is used. This makes it possible to suppress the deterioration of separation capacity caused by intra-column diffusion of an analyte.

Further, as shown in FIG. 4, when the spherical holes 13 are regularly arranged to form a close-packed structure, the local structure of the porous self-standing structure is geometrically uniform and has periodicity. This makes it possible to provide a column having a porous self-standing structure which can achieve constant separation accuracy.

Hereinbelow, an organic porous self-standing structure will be described.

SSS type of (2,2,2)-tri-(2,3-epoxypropyl)-isocyanurate (TEPIC-S), which is an optically active material, is used as an epoxy compound, bis(4-aminocyclohexyl)methane (BACM) is used as an amine compound, and polyethylene glycol having a molecular weight of 200 (PEG200 manufactured by Nacalai tesque) is used as a porogen (see Non-Patent Document 1).

TEPIC and BACM have the following chemical structural formulas.

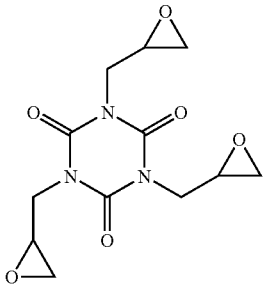

TEPIC

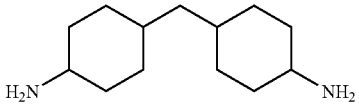

BACM 1.6 g of TEPIC-S, 0.37 g of BACM, and 7.00 g of PEG200 are mixed together to obtain a mixture, and the mixture is heated and stirred with a hot stirrer until TEPIC-S and BACM are dissolved in PEG200. Then, the mixture is charged into a fused quartz capillary by a method which will be described later, and is then heated in an oven at 80° C. for 20 hours to polymerize TEPIC-S and BACM. Then, the capillary is washed with water and methanol, and vacuum-dried.

| Production Conditions | |
|---|---|
| TEPIC-S | 1.6 g |
| BACM | 0.37 g |
| PEG200 | 7.00 g |
| Temperature | 80° C. |

A scanning electron micrograph of an organic polymer monolith produced by polymerization in such a manner as described above is shown in FIG. 5. As can be seen from FIG. 5, the organic polymer has a skeletal phase having a submicron-sized average diameter, the skeletal phase has a non-particle-aggregation-type co-continuous structure, and pores formed by the skeletal phase form a three-dimensional network.

Figure 6A:
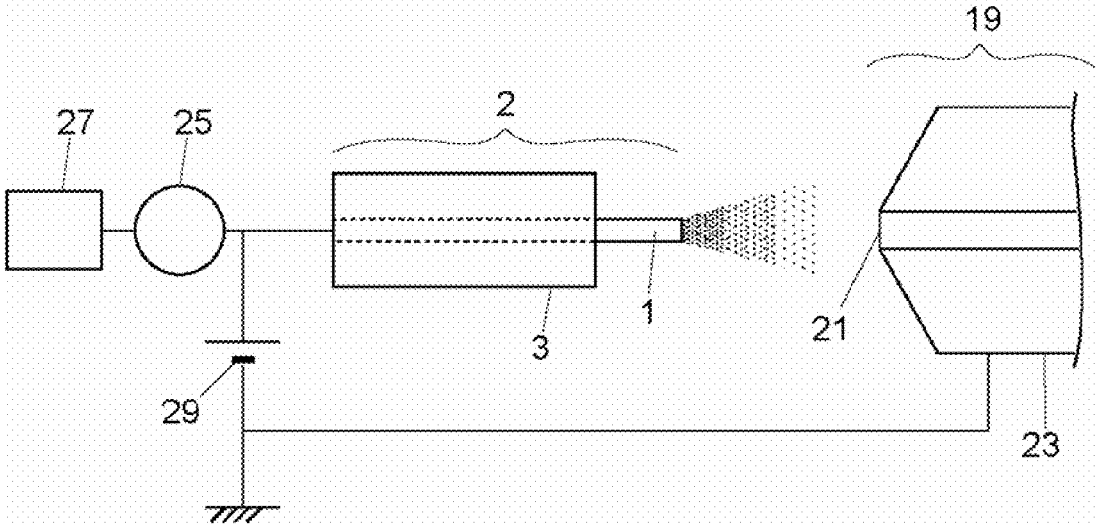
FIG. 6A is a schematic view of an ionization apparatus using an ionization emitter 2 according to the present invention in which a tip 1 is not coated with a conductive film.
Figure 6B:
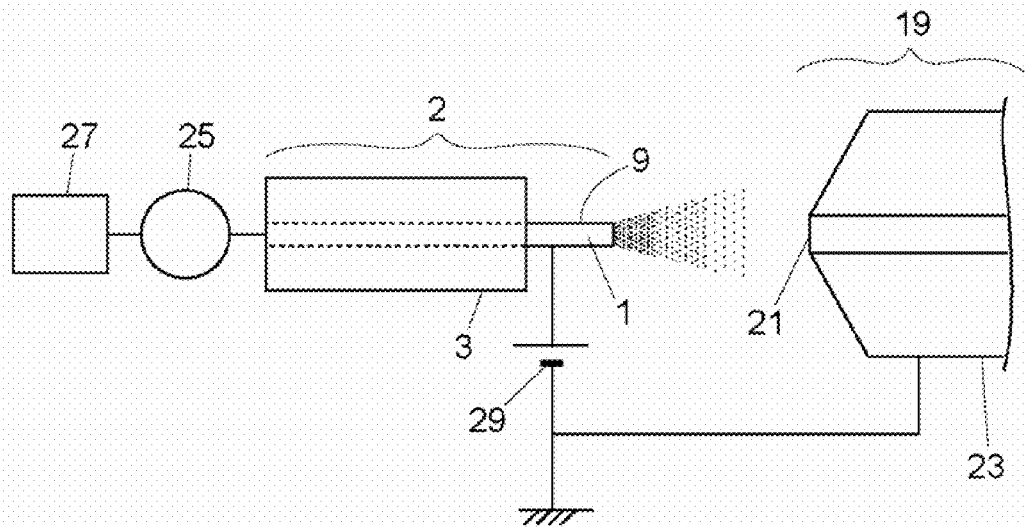
FIG. 6B is a schematic view of an ionization apparatus using an ionization emitter 2 according to the present invention in which a tip 1 is coated with a conductive film.

FIG. 6A is a schematic view of an ionization apparatus using the ionization emitter 2 according to the present invention in which the tip 1 is not coated with a conductive film, and FIG. 6B is a schematic view of another ionization apparatus in which the tip 1 is coated with the conductive film 9. The ionization apparatus is used to ionize and measure molecules contained in a solution sample supplied into the tip 1 by electrospray initiated by applying a high voltage across the tip 1 and an electrode 19 provided so as to be opposed to the distal end of the tip 1.

The electrode 19 has a sample inlet 21 provided so as to be opposed to the tip 1, and therefore a sample is introduced into a mass spectrometer 23 through the sample inlet 21 and then measured by the mass spectrometer 23.

In this ionization apparatus, the tip 1 is integrally formed with the analytical column 3 so as to be located at the distal end of the analytical column 3. Further, an injector 25 for supplying a sample to the column 3 and a pump 27 for sending a mobile phase for carrying a sample to the column 3 are connected to the base end of the analytical column 3. In this case, a sample carried by a mobile phase to the column 3 is separated by the column 3, and sample ions are discharged from the distal end of the tip 1 and introduced into the mass spectrometer 23.

In the case of FIG. 6A, one end of a high-voltage generating device 29 is connected to the mass spectrometer 23 and the other end of the high-voltage generating device 29 is connected to the base end of the ionization emitter 2 to apply a high electric field across the ionization emitter 2 and the mass spectrometer 23. In the case of FIG. 6B, since the tip 1 is coated with the conductive film 9, one end of the high-voltage generating device 29 is connected to the mass spectrometer 23 and the other end of the high-voltage generating device 29 is connected to the conductive film 9 of the tip 1.

By these methods, molecules ionized by a high electric field are discharged from the distal end of the tip 1, and are then introduced into the mass spectrometer 23 through the sample inlet 21 and measured by the mass spectrometer 23.

Hereinbelow, a method for manufacturing an ionization emitter according to the present invention will be described.

Figure 7:
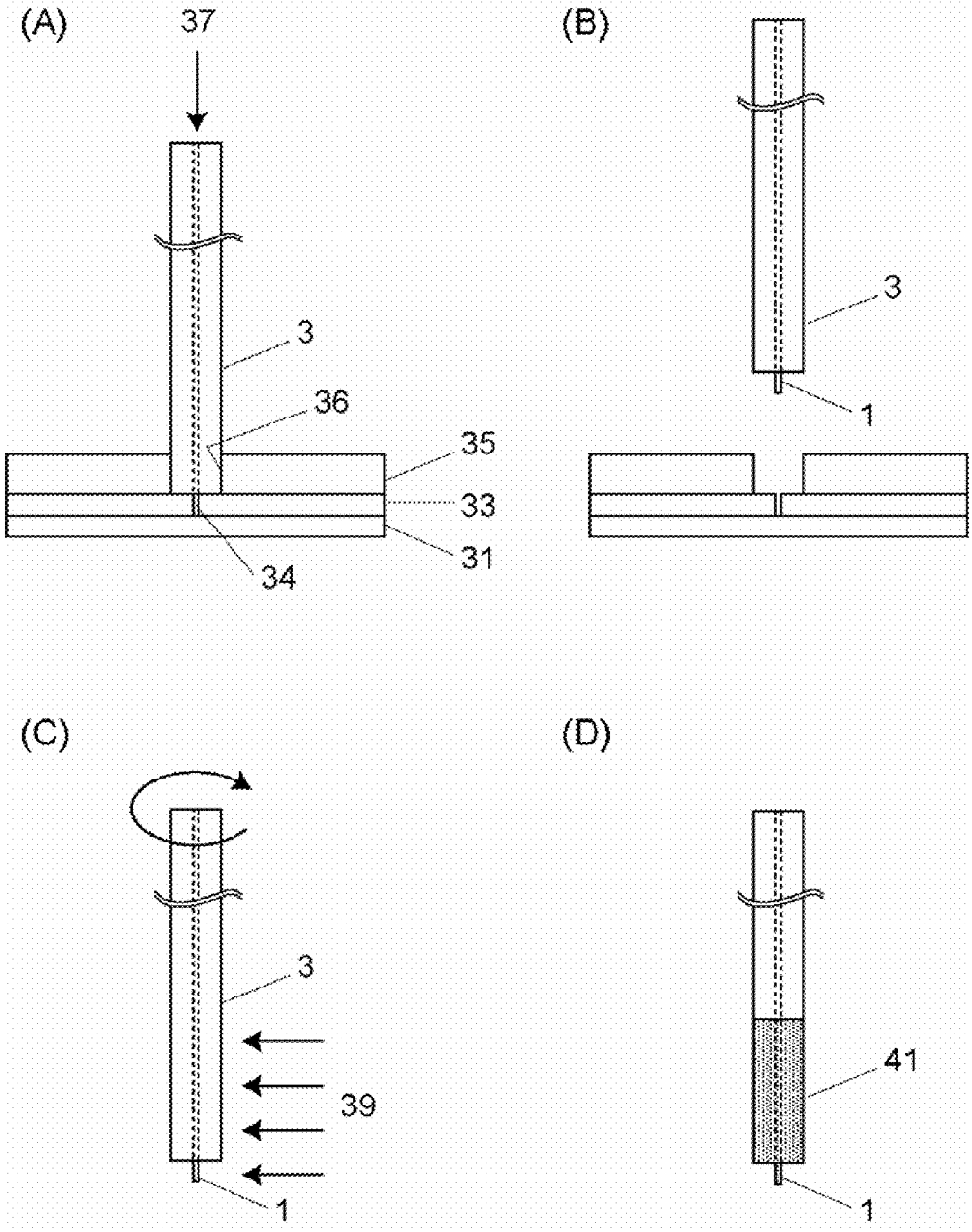
FIG. 7: (A) to (D) shows a flow chart for indicating production steps of one example of a method for producing a porous self-standing structure by a sol-gel method.

FIG. 7 is a flow chart showing the process of producing a porous self-standing structure by a sol-gel method.

(A) A concave mold (hole) having a coaxial structure is formed using photoresists 33 and 35 provided on a substrate 31. A hole 34 of the mold formed using the photoresist 33 has a shape corresponding to the outside shape of a tip 1 that should be formed using the mold. A hole 36 of the mold formed using the photoresist 35 is provided to insert the distal end portion of a hollow tube to align the hollow tube with the hole 34. A column 3 such as a fused silica capillary is used as the hollow tube, and the distal end portion of the column 3 is inserted into the mold. The distal end surface of the column 3 has an outer diameter larger than the diameter of the hole 34. The column 3 and the mold formed using the photoresists 33 and 35 are filled with a silica sol 37.

(B) The silica sol 37 is turned into a gel, and then the column 3 and a molded product are removed from the mold formed using the photoresists 33 and 35 to obtain a porous self-standing structure. The obtained porous self-standing structure includes the tip 1 and the silica momolithic column 3.

(C) The tip 1 and the column 3 integrated with each other are rotated to form a conductive metal thin film 41 on the outer wall of the tip 1 and the column 3 by vapor deposition 39.

(D) After the conductive metal thin film 41 is formed on the outer wall of the tip 1 and the column 3, the inner surface of pores formed by the skeletal phase of the tip 1 and the column 3 is chemically modified with a silylation agent such as octadecylsilane.

Such a porous self-standing structure having a skeletal phase made of silica having a high covalent bond strength is expected to have higher resistance to hydraulic pressure.

Figure 5:
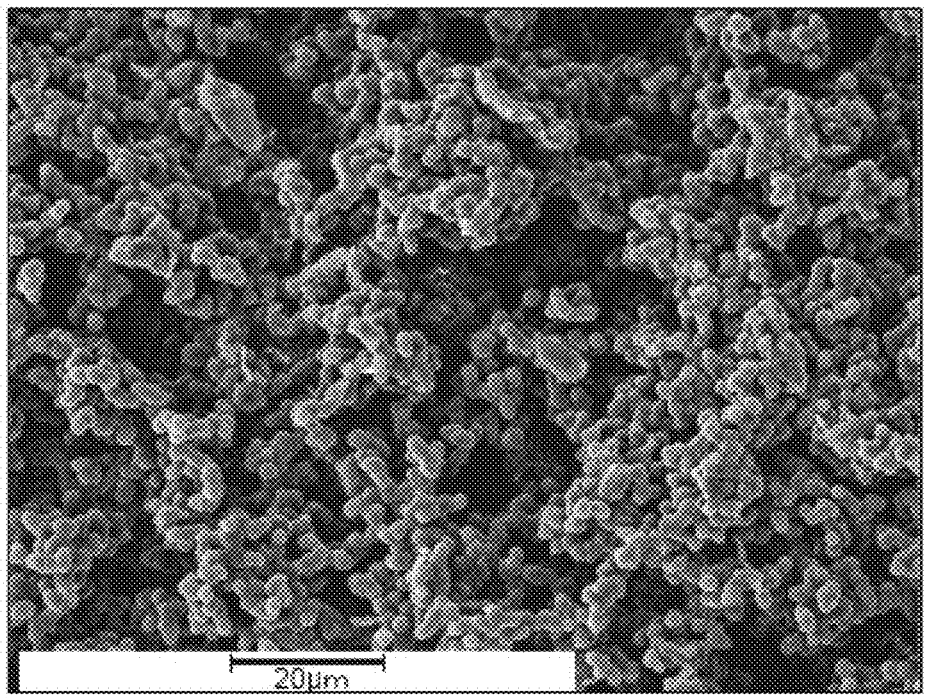
FIG. 5 is a scanning electron microscope image showing the cross section of yet another example of the porous self-standing structure.

The organic porous self-standing structure shown in FIG. 5 can be produced also by the method for producing a porous silica self-standing structure described above with reference to FIG. 7. In this case, a sol obtained by dissolving TEPIC and BACM in PEG is injected into the column 3 and the mold formed using the photoresists 33 and 35 instead of the silica sol 37, and is then allowed to gelate.

Figure 8:
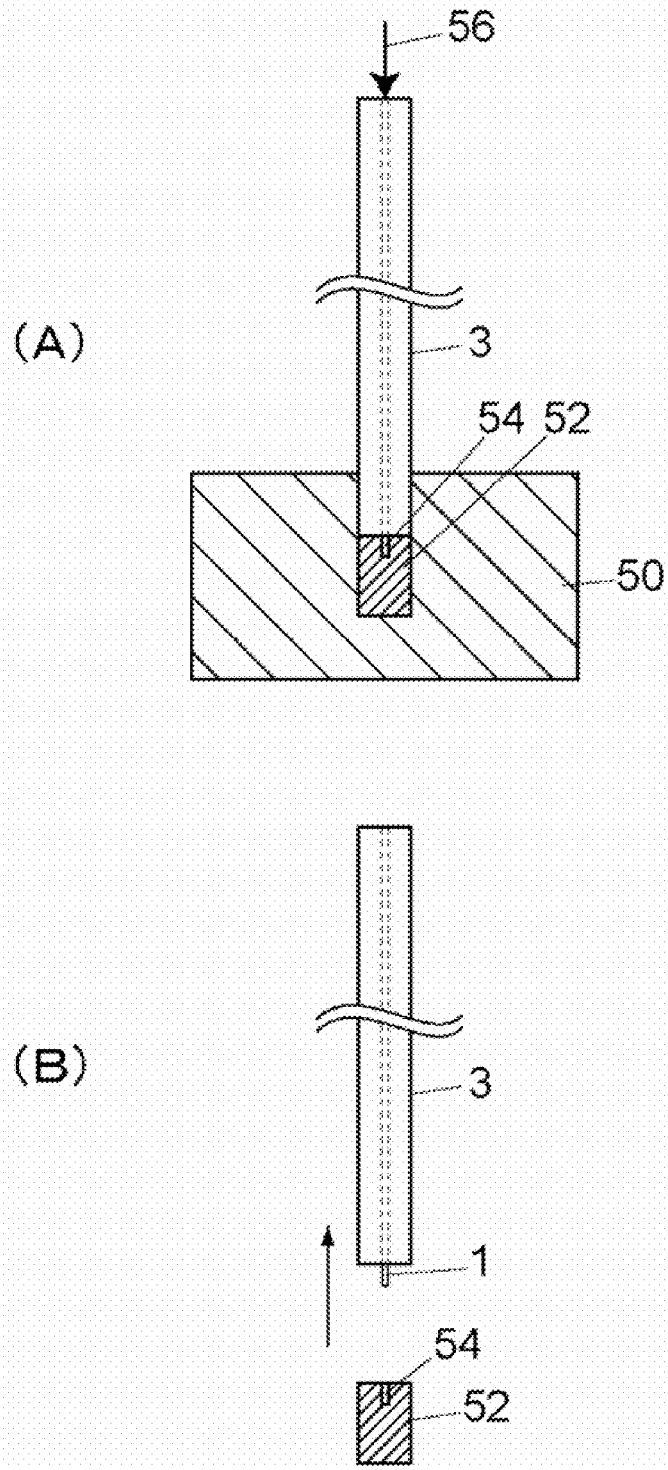
FIG. 8: (A) and (B) shows a flow chart for indicating the first half process of production steps of another example of the method for producing a porous self-standing structure.

FIG. 8 shows another method for producing a porous self-standing structure. According to this method, a jig 50 having a cylindrical hole with an inner diameter equal to the outer diameter of a column 3 such as a fused silica capillary is prepared, and a fluorine resin tube 52 having an outer diameter equal to the inner diameter of the hole of the jig 50 is placed at the bottom of the hole of the jig 50 to form a mold. The fluorine resin tube 52 has a hole 54, and the hole 54 may be either a hole having a certain depth or a through hole.

As shown in FIG. 8(A), a distal end portion of the column 3 such as a fused silica capillary is inserted into the hole of the jig 50 so that the distal end surface of the column 3 is brought into contact with the fluorine resin tube 52, and in this state, a sol is injected from the base end side of the column 3, and is then heated for gelation. The sol may be either inorganic or organic.

After the completion of gelation, as shown in FIG. 8(B), the column 3 and the fluorine resin tube 52 are together pulled out of the jig 50, and then the fluorine resin tube 52 is removed from the distal end of the column 3. In this way, a porous self-standing structure 1 is integrally formed with a packing filling the column 3 so as to project from the distal end of the column 3.

Figure 9:
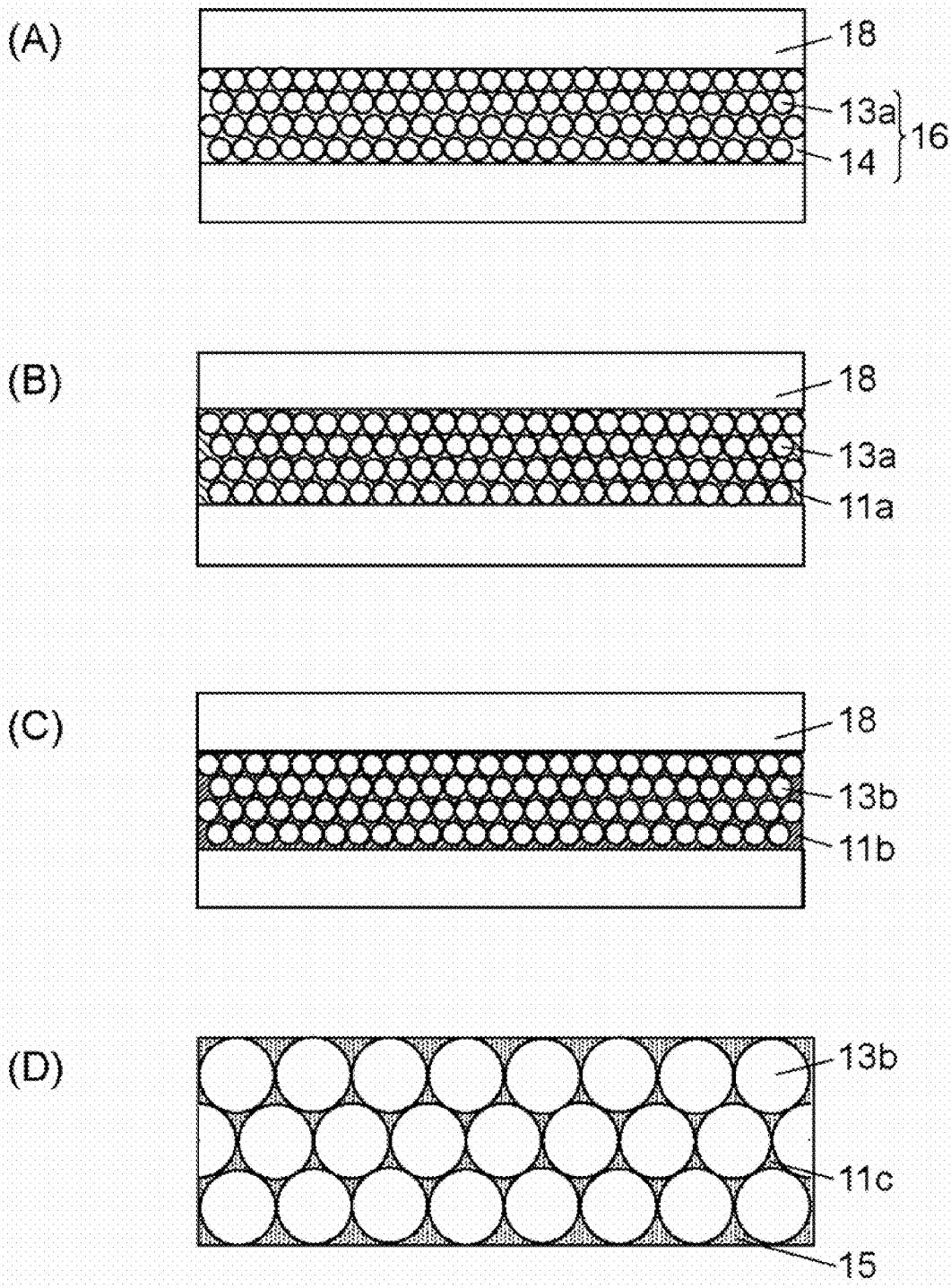
FIG. 9: (A) to (D) shows a flow chart for indicating production steps of yet another example of the method for producing a porous self-standing structure.
Figure 10:
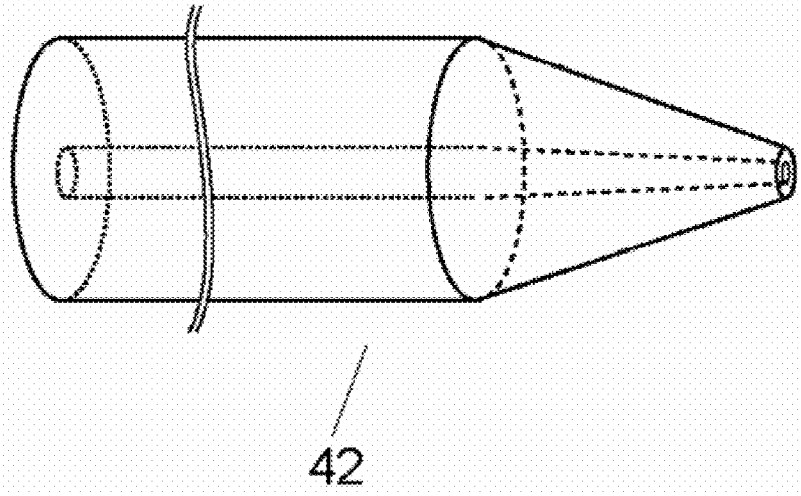
FIG. 10 is a schematic view of a conventionally used emitter.

Yet another method for producing a porous self-standing structure will be described step by step with reference to steps (A) to (D) in FIG. 9.

(A) First, a monodisperse colloid containing a plurality of polymer particles having a particle size distribution of less than 20% is prepared. For example, a 1 wt % polystyrene colloid 16 obtained by dispersing polystyrene particles 13*a* having a diameter of 1 to 3 μm in pure water 14 is prepared.

The polystyrene colloid 16 is injected into a hollow tube 18 having an inner diameter of 50 μm by the use of a syringe pump to fill the inside of the hollow tube 18 with the polystyrene particles 13*a*. At this time, the polystyrene particles 13*a* form a packed structure (e.g., a hexagonal close-packed structure) in which they are regularly arranged due to their self-assembly properties.

(B) Then, a metal alkoxide sol for forming a skeletal phase of a porous self-standing structure is prepared. For example, under ice cooling, 1.3 g of polyethylene glycol and 4 mL of tetramethoxysilane ($Si(OCH_3)_4$) are added to 10 mL of 20 mM acetic acid to obtain a mixture, and the mixture is stirred for 45 minutes to prepare a silica sol.

The silica sol is injected into the hollow tube 18 filled with the polystyrene particles 13*a* by the use of a syringe pump. The silica sol 11*a* injected into the hollow tube 18 fills the interstices between the polystyrene particles 13*a* forming a packed structure.

(C) Then, the silica sol injected into the hollow tube 18 is allowed to gelate. For example, the hollow tube 18 is heated in an electric furnace at 40° C. for 24 hours to allow the silica sol 11*a* to form a skeletal phase (silica gel 11*b*) by gelation.

Then, the temperature of the electric furnace is increased to 330° C. at a rate of 1° C./min to bake the silica gel 11*b*. As a result, the polystyrene particles 13*a* filling the inside of the hollow tube 18 are thermally decomposed into water and carbon dioxide, and the water and the carbon dioxide are discharged into the outside so that vacancies remain as spherical holes 13*b*.

(D) In this way, a skeletal phase 11*c* of a porous silica self-standing structure is formed using a packed structure of polystyrene particles as a template. The skeletal phase 11*c* has a three-dimensional network structure because the adjacent spherical holes 13*b* communicate with each other at their contact point.

The porous self-standing structure whose scanning electron microscope image is shown in FIG. 4 is one produced by the method described above with reference to FIG. 9. The porous self-standing structure shown in FIG. 4 has a skeletal phase 11 having a structure in which a plurality of spherical holes 13 formed using a packed structure of particles as a template are provided. The skeletal phase 11 has a three-dimensional network structure because the adjacent spherical holes 13 communicate with each other at their contact point. This is different from the porous self-standing structure shown in FIG. 3 in that the size of the spherical holes 13*b* is controlled using polymer particles as a template and that the holes are orderly arranged.

Further, according to the method for producing a porous self-standing structure described above with reference to FIG. 9, it is possible to produce a geometrically-uniform monolithic column having periodicity, whereas it is difficult for a conventional production method based on a spinodal decomposition to produce such a monolithic column. Such a monolithic column is expected to achieve higher performance because it is possible to suppress the deterioration of its separation capacity caused by intra-column diffusion of an analyte resulting from the nonuniformity of a column.

Further, the porous self-standing structure is preferably subjected to physical or chemical surface modification. Physical surface modification is performed by, for example, causing the surface of the holes 13 to corrode with ammonia to form mesopores 15 in the surface of the skeletal phase 11 (in the surface of the holes 13 of the porous self-standing structure). More specifically, the skeletal phase 11 is easily microfabricated by washing with an alkaline solution so that mesopores 15 having a diameter smaller than that of the spherical holes 13 are formed in the skeletal phase 11. This increases the surface area, thereby improving the separation performance of the column 3.

As a result, the porous self-standing structure has the skeletal phase 11 having the mesopores 15 with a diameter of 0.01 to 0.1 μm and the spherical holes 13 with a diameter of 0.8 to 2.7 μm formed by the skeletal phase 11.

On the other hand, chemical surface modification is performed by, for example, chemically binding a stationary phase to the surface of the porous self-standing structure by the use of a silylation agent such as chlorooctadecylsilane.

The porous self-standing structure according to the present invention can also be used as a packing for chromatographic columns and capillaries. For example, a column using the porous self-standing structure according to the present invention as a packing can be connected to a mass spectrometer to analyze a sample separated by this column.

Further, the tip 1 may have a conical shape instead of a columnar shape. The tip 1 having a conical shape is advantageous in that an electric field is easily concentrated at the distal end of the tip so that a stable plume is obtained.

Industrial Applicability

The present invention can be applied to ionization emitters for use in, for example, separation analysis and mass spectrometric analysis of chemical and biological materials.

What is claimed is:

1. An ionization emitter comprising:

a tip; and a channel for supplying a solution sample into the tip from the base end side of the tip, wherein the channel is formed by filling a pipe line with a packing, and the tip constitutes a columnar or conical porous self-standing structure projecting from the pipe line of the channel to expose a distal end surface and a lateral surface thereof, the packing and the porous self-standing structure constituting the tip having been simultaneously and integrally formed as a single structure and composed of a same porous body, and wherein a high voltage is applied between the tip and an electrode provided so as to be opposed to the distal end side of the tip to generate electrospray to ionize molecules contained in the solution sample supplied into the tip.

2. The ionization emitter according to claim 1, wherein the channel is an analytical column.

3. The ionization emitter according to claim 1, wherein the porous body has been formed by a sol-gel method.

4. The ionization emitter according to claim 1, wherein the porous body has a skeletal phase having a structure in which a plurality of spherical holes formed by molding using a packed structure of particles are provided, and wherein the adjacent spherical holes communicate with each other at their contact point so that the skeletal phase has a three-dimensional network structure.

5. The ionization emitter according to claim 4, wherein the spherical holes are regularly arranged to form a close-packed structure.

6. The ionization emitter according to claim 4, wherein the spherical holes have a diameter of 0.1 to 10 μm and a hole size distribution of less than 20%.

7. The ionization emitter according to claim 4, wherein the skeletal phase has mesopores having a diameter smaller than that of the spherical holes.

8. The ionization emitter according to claim 3, wherein the skeletal phase is made of silica.

9. The ionization emitter according to claim 1, wherein the porous body has a skeletal phase having a surface, pores formed by the skeletal phase and forming a continuous three-dimensional network, and a functional group present on the surface of the skeletal phase and permitting introduction of another functional group, and wherein the skeletal phase has a submicron- to micrometer-sized average diameter and a non-particle-aggregation-type co-continuous structure, and is composed of an addition polymer formed from a di- or higher-functional epoxy compound and a di- or higher-functional amine compound, and is rich in organic matter, and contains no aromatic carbon atoms.

10. The ionization emitter according to claim 9, wherein the epoxy compound is 2,2,2-tri-(2,3-epoxypropyl)-isocyanurate.

11. The ionization emitter according to claim 2, wherein the packing within the column is physically or chemically modified.

12. The ionization emitter according to claim 1, wherein a coating film made of an electrode or a protective film is formed on an outer surface.

13. The ionization emitter according to claim 12, wherein the electrode or the protective film is formed by physical or chemical vapor deposition.

14. An ionization apparatus comprising:

the ionization emitter according to claim 2;

a mobile phase supplying system for supplying a mobile phase to the column;

an injector for supplying a sample into a channel for supplying the mobile phase to the column;

a sample inlet provided so as to be opposed to the distal end side of the emitter; and a high-voltage generating device for applying a voltage across the emitter and the sample inlet.

15. A method for manufacturing the ionization emitter according to claim 1, comprising the steps of:

(A) preparing a mold having a hole in a shape corresponding to an outside shape of the tip; and (B) forming the porous self-standing structure, comprising the steps of: pressing a distal end surface of a hollow tube having an outer diameter larger than a diameter of the hole against the mold in such a state that the hollow tube is aligned over the hole of the mold; injecting a sol from a base end side of the hollow tube; and turning the sol into a gel.

16. The method according to claim 15, wherein the step (B) comprises the steps of:

(B-1) injecting a colloid containing polymer particles from the base end of the hollow tube;

(B-2) forming a packed structure in which the polymer particles are regularly arranged due to their self-assembly properties;

(B-3) injecting a metal alkoxide sol to fill interstices between the polymer particles forming the packed structure;

(B-4) allowing the metal alkoxide sol to form a skeletal phase by gelation; and (B-5) thermally decomposing and removing the polymer particles to form a porous self-standing structure having a three-dimensional network structure having a plurality of spherical holes formed by molding using the packed structure.

17. The method according to claim 16, further comprising, after the completion of formation of the porous self-standing structure, the step of physically modifying the porous self-standing structure by washing the skeletal phase with an alkaline solution to form mesopores having a diameter smaller than that of the spherical holes in the skeletal phase.

18. The method according to claim 16, wherein the metal alkoxide sol is a silica sol.

19. The method according to claim 16, wherein the colloid is obtained by dispersing polystyrene polymers in pure water.

20. The method according to claim 15, wherein the step (B) comprises the steps of:

(b-1) injecting a solution containing a di- or higher-functional epoxy compound and a di- or higher-functional amine compound in a porogen as a sol solution followed by polymerization by heating to form a gelled body; and (b-2) washing the gelled body with a solvent to remove the porogen to obtain a skeletal phase.

21. The method according to claim 20, wherein the epoxy compound is 2,2,2-tri-(2,3-epoxypropyl)-isocyanurate.

* * * * *